United States Patent [19]

Eaton-Williams

[11] 4,418,269

[45] Nov. 29, 1983

[54] MULTI-ELECTRODE BOILER

[76] Inventor: Raymond H. Eaton-Williams, "Heathers" Farnaby Dr. Sevenoaks, Kent, England TN13 2LQ

[21] Appl. No.: 244,621

[22] Filed: Mar. 17, 1981

[30] Foreign Application Priority Data

Mar. 24, 1980 [GB] United Kingdom ..... 8009842

[51] Int. Cl.[3] ..... H05B 1/02; H05B 3/60

[52] U.S. Cl. ..... 219/295; 219/272; 219/285

[58] Field of Search ..... 219/286, 287, 272, 285, 219/295

[56] References Cited

U.S. PATENT DOCUMENTS

| | | | |
|---|---|---|---|
| 1,941,020 | 12/1933 | Poindexter | 219/287 |
| 2,783,355 | 2/1957 | Vassiliev | 219/295 |
| 3,020,385 | 2/1962 | Conlin | 219/272 |
| 3,141,918 | 7/1964 | Tanaka | 219/295 |
| 3,944,785 | 3/1976 | Eaton-Williams | 219/295 |
| 4,206,340 | 6/1980 | Osrow | 219/295 |
| 4,262,191 | 4/1981 | Lepper | 219/295 |

FOREIGN PATENT DOCUMENTS

| | | | |
|---|---|---|---|
| 7426506 | 2/1976 | France | 219/295 |

*Primary Examiner*—B. A. Reynolds
*Assistant Examiner*—T. J. Walberg
*Attorney, Agent, or Firm*—Berman, Aisenberg & Platt

[57] ABSTRACT

A multi-electrode boiler, especially for use as a humidifier, comprising water-changing means arranged to allow at least some of the water in the boiler to be changed, monitoring means arranged to monitor the electrical-current which flows through at least one of the electrodes of the boiler, control means responsive to the monitoring means to control the change of at least some of the water in the boiler to maintain the electrical-current in said at least one monitored electrode within a predetermined range of values, in which switching circuitry is provided to switch in and out electrodes of the boiler to vary the boiling rate.

10 Claims, 6 Drawing Figures

3140
IC5
72
C6
70
R37
5M6
R38
10M
58
R18
470K
C9
560p
D9
IC3
C7
3140
56
R19
6K8
R20
5M6
32
R46
100
60
R21
10M
R22
10M
C9
0·1μ
C10
0·1μ
VCC1
62
R24
22K
AOT
R23
3130
IC4
C5
560p
R33 100K
R32
10K
6
IC2
4
5
64
+V
10M
10M
0·1μ
1
IC2
3
2
68
In
52
VCC1
49
R8
1M
R6
10M
10M
R7
R10
1M8
R3
22K
277W
R4
3K3
R5
100K
0·1μ
IC1
3130
560p
R9
1M
50

MULTI-ELECTRODE BOILER

The present invention relates to a multi-electrode boiler, and more especially to a multi-electrode boiler in which water is boiled to produce steam for an air-conditioning system. In other words, the boiler may be a humidifier.

In U.S. Pat. No. 3,780,261 there is described an electrode boiler which is generally cylindrical with its axis vertical, and which has a height greater than its diameter, although it is to be understood that other shapes could be used instead. The boiler has a steam outlet at its top and a port at the bottom which serves both as a water inlet and as a water outlet. The boiler contains elongate water-heating electrodes arranged vertically and extending over most of the height of the boiler. The arrangement of the electrodes may be varied in dependence upon whether the boiler is provided with electrodes for single-phase or three-phase A.C. operation.

Water inflow into and outflow from the boiler is controlled by a solenoid-operated feed valve and a solenoid-operated drain valve. The valves are arranged on opposite sides of a T-junction having its central branch connected to the bottom part of the boiler, the feed valve being on the upstream side of the T-junction and the drain valve on the downstream side in relation to a water supply.

During operation, as water is boiled away from the boiler, the water level steadily goes down. As a result, the effective lengths of the electrodes becomes shorter, the electrical current through the water decreases, and the rate of production of steam falls. To compensate for this, control circuitry of the boiler automatically opens the feed valve to raise the water level and correct the steam production rate. This rate is determined by a selected threshold current valve and is automatically maintained in this way. If it is now desired to reduce the rate of steam production, for example due to a change in weather conditions that increase the natural humidity of a controlled environment, the threshold current is lowered by, say, a change in a variable resistor in the control circuitry. Recognising that the boiler is now operating at a current which is too high, the control circuitry opens the drain valve to lower the water level until the boiler operates at the newly selected threshold value.

A disadvantage of this method of controlling steam production is the loss of hot water through draining when the production rate is lowered, with its consequent energy wastage. This loss has to be made up when the steam production rate is increased by bringing a large quantity of fresh water to boiling point, and little steam is produced during this delay.

It is an aim of the present invention to avoid this disadvantage, or at least to provide a boiler which is less subject to this disadvantage.

According to a first aspect of the present invention, it is directed to a multi-electrode boiler, especially for use as a humidifier, comprising inlet and/or outlet means through which water can flow into and/or out of the boiler, electrical-current sensing means arranged to sense the electrical-current which flows through one or more of the electrodes of the boiler or a current corresponding thereto, and control means responsive to the electrical-current sensing means to control the inflow and/or outflow of water into and/or out of the boiler to maintain the electrical-current in the monitored electrode or electrodes within a predetermined range of values, in which switching circuitry is provided to switch in and out electrodes of the boiler to vary the boiling rate.

Whilst it would be thought that this would result in different degrees of scaling of solid matter on the different electrodes, with the danger of excessive current being passed through the least-scaled electrode, experiments have shown unexpectedly that this does not in fact occur. Minerals or other contamination of the water is deposited on the electrodes at a rate which is independent of how much current passes through them.

The switching circuitry may include a humidity sensor, connected to increase the number of the electrodes which are switched in as the sensed humidity decreases. In the reverse direction, as the humidity increases the switching circuitry progressively and automatically decreases the number of electrodes switched in as the humidity detected by the sensor approaches a predetermined desired value. In this way, the number of electrodes switched in may be proportional to the difference between the desired value of the humidity and the actual value.

In another of its aspects, the invention is directed to a method of producing steam using a multi-electrode boiler in accordance with the foregoing first aspect of the present invention.

An example of a multi-electrode boiler in accordance with the present invention is illustrated in the accompanying drawings, in which.

Figure 3A:
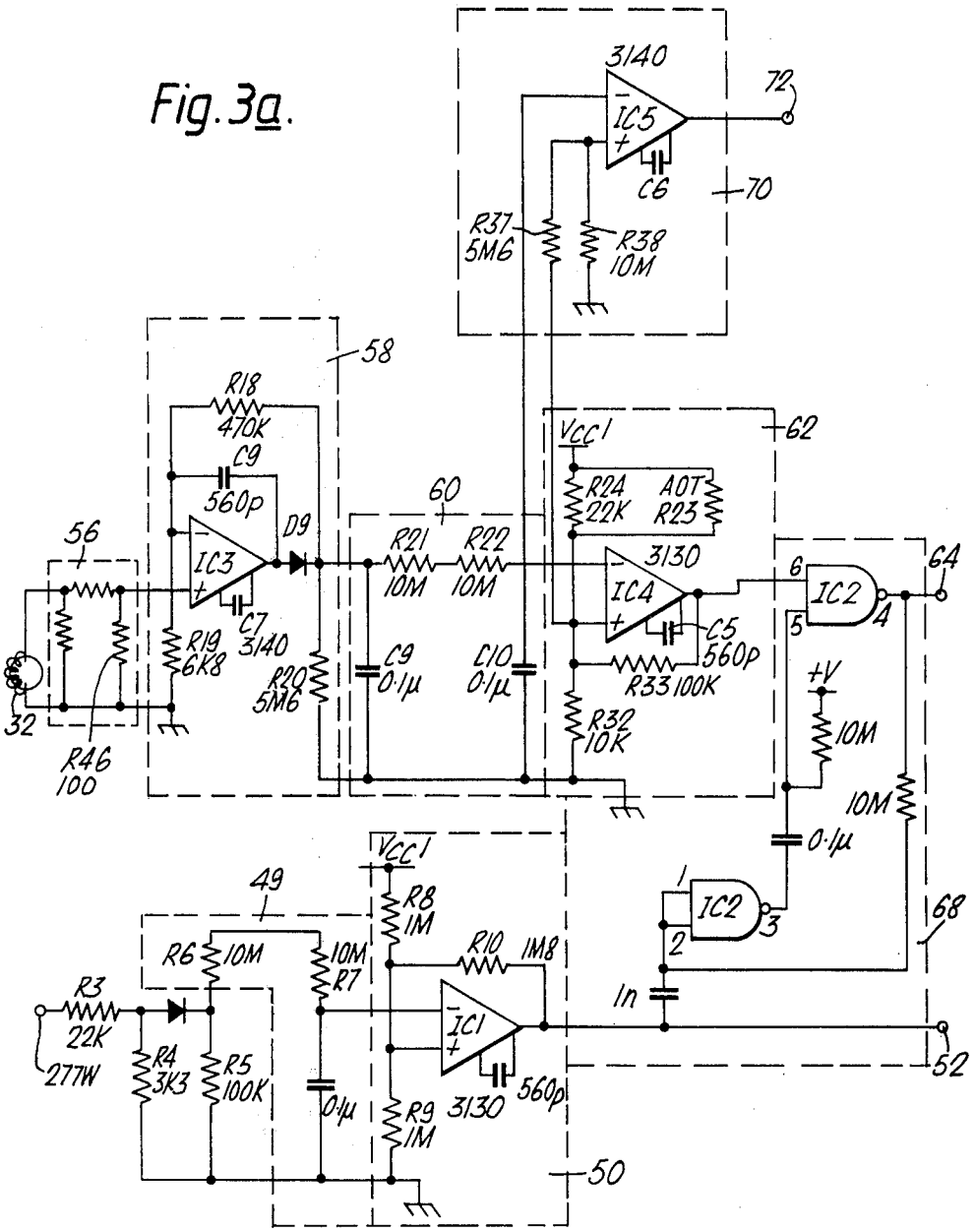
Figure 3B:
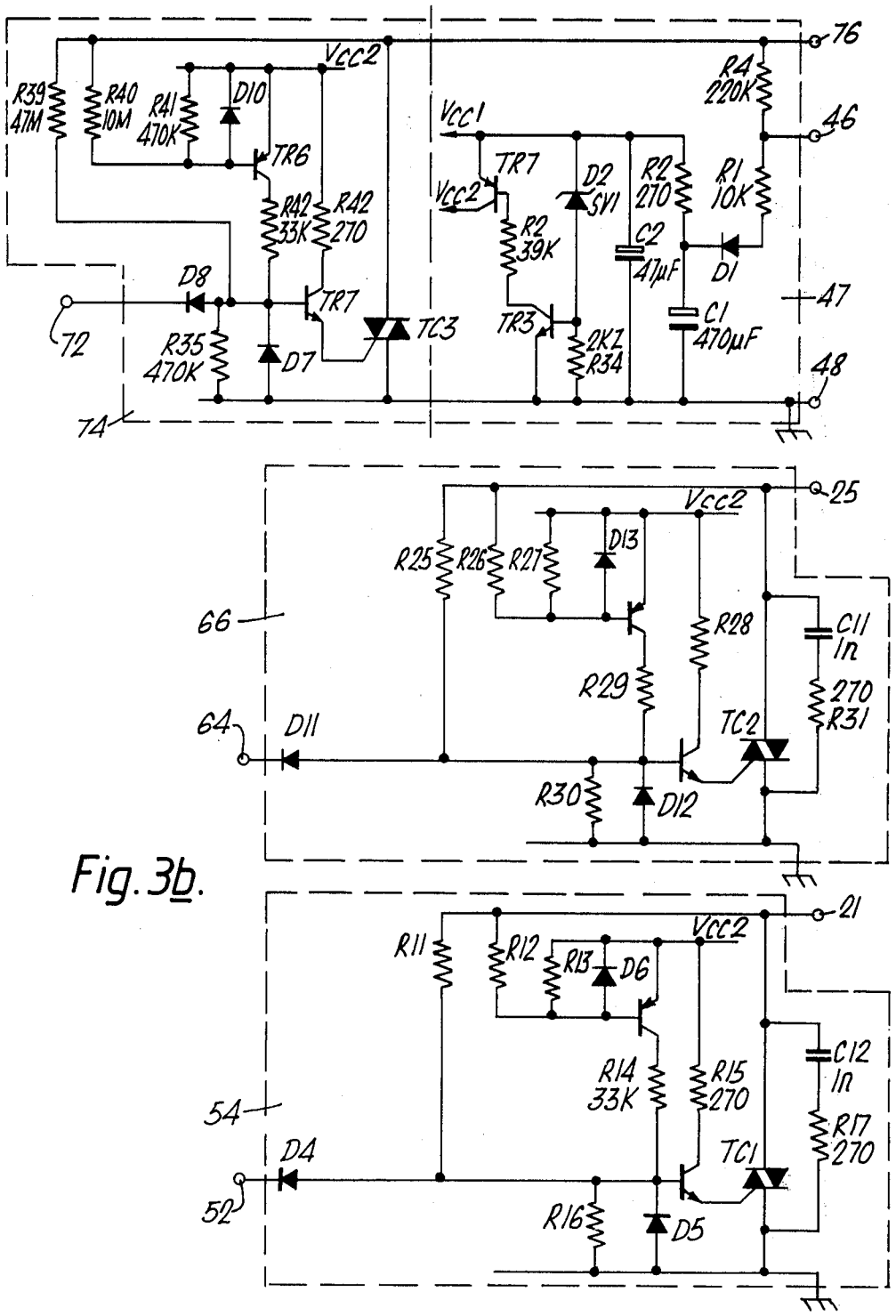
Figure 4:
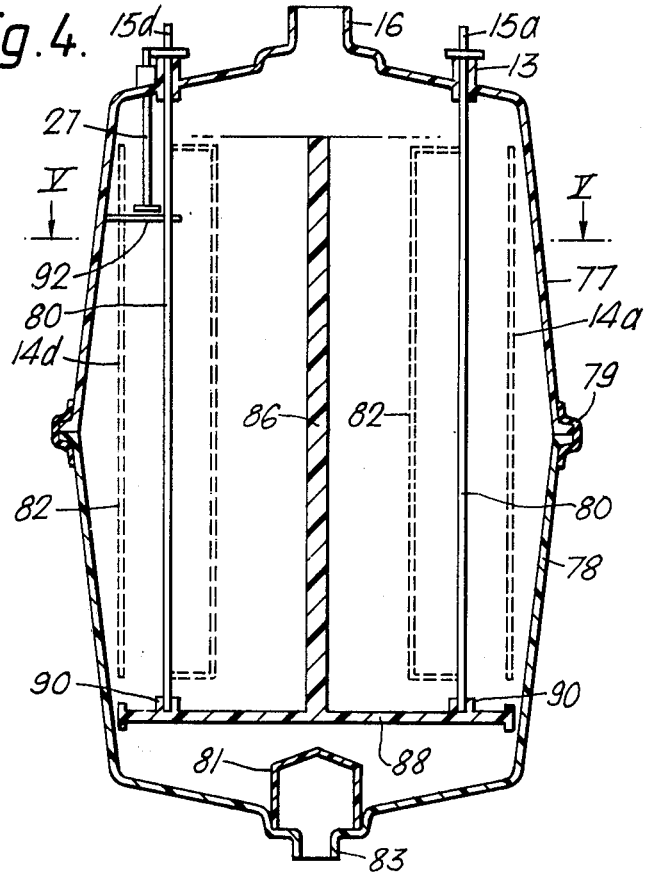
Figure 5:
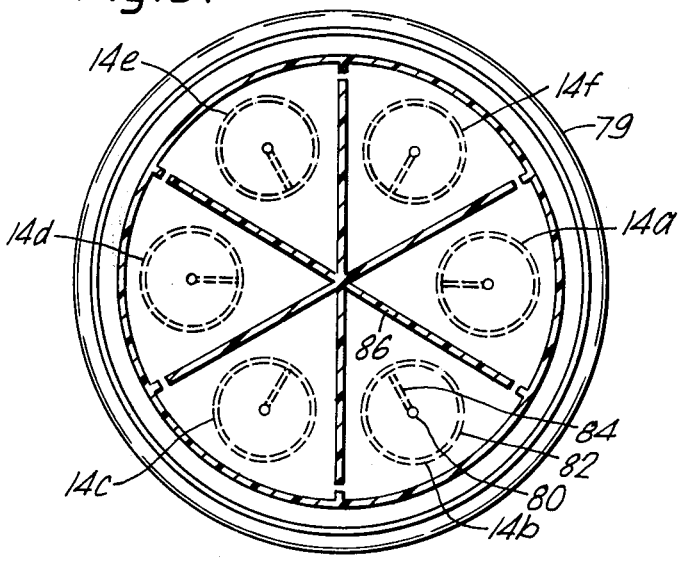

FIGS. 3*a* and 3*b* together show one possible circuit for controlling operation of valves connected to control feed and drain of water into and out of the boiler;

FIG. 4 is an axial vertical sectional view through one particular structure of boiler; and FIG. 5 is a cross-sectional view along the line V—V of FIG. 4.

Figure 1:
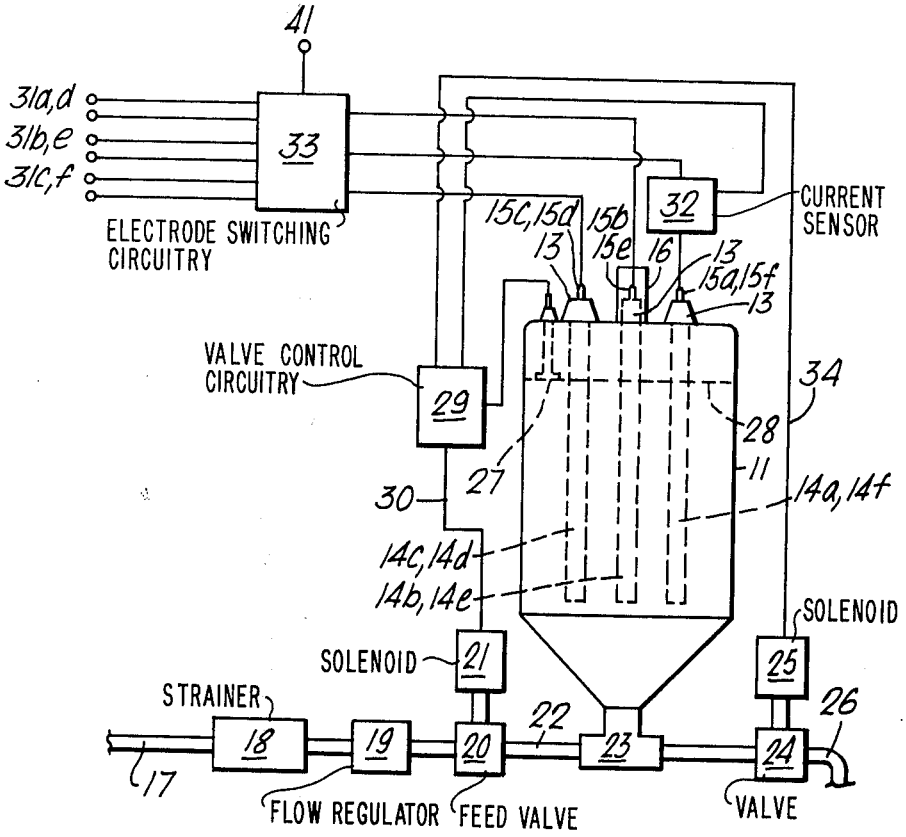
FIG. 1 is a diagram showing the multi-electrode boiler in elevation and control apparatus thereof.

The multi-electrode boiler shown in FIG. 1 comprises a moulded container 11, which may conveniently be made of polypropylene or other synthetic plastics material, the general structure of the boiler being inexpensive so that, when it is thoroughly contaminated with solid matter, it may be thrown away rather than dismantled and descaled. The moulded container includes bushes 13 which support six elongate, mutually parallel and vertically arranged electrodes 14*a* to *f* (shown dotted). To avoid a too densely packed drawing in FIG. 1, the electrodes have been paired together so that the electrodes 14*c* and 14*d* are shown as one, as are electrodes 14*b* and 14*c* and electrodes 14*a* and 14*f*. The electrodes 14*a* to *f* are supported inside the boiler and have respective electrical connections 15*a* to *f* at their upper ends. The electrodes can be cylinders or rolls of wire mesh, or they can be of other suitable shapes to suit particular boiler characteristics. The actual arrangement of the electrodes in the boiler is shown more clearly in FIGS. 4 and 5.

The six electrodes are connectable through switching circuitry 33 to respective inputs 31*a* to *f* in dependence upon the humidity detected by the humidity sensor 41 of the circuitry. When all the electrodes are switched in, the electrodes 14*a* to *f* are connected respectively to the inputs 31*a* to *f*. The inputs 31*a* and 31*d* have one phase of a three-phase supply applied to them during operation of the boiler. The inputs 31*b* and 31*e* have the second phase, and 31*c* and 31*f* the third.

The boiler may be of any desired size, but a convenient size which has a large field of application holds about six liters of water (about one and a third gallons) with a boiling space at the top. At the top of the container is an integral or moulded-on tube 16 through which steam is discharged at substantially atmospheric pressure for use in an air-conditioning system. However, if the boiler discharges into a steam hose or into a duct through which air is being blown by a fan, the steam discharge may be slightly above atmospheric pressure.

Water is supplied to the boiler through an inlet pipe 17 leading to a strainer 18 from which the water flows through a flow regulator 19. This may conveniently be an automatic flow or pressure regulating device of a kind which is available on the market. From the flow regulator 19 the water passes to an electrically-controlled feed valve 20 actuated by a solenoid 21. The water then passes through a pipe 22 to one arm of a "T" piece 23 fixed to the bottom of the container 11. The other arm of the "T" piece 23 forms an outlet, and this is connected to a second electrically-controlled valve 24 actuated by a solenoid 25. Water passing through the valve 24 passes into a drain pipe 26.

A level sensing electrode 27 is included in the container 11 in order to maintain the water level in the boiler substantially at the level indicated by the dotted line 28. The sensing electrode 27 is connected to valve control circuitry 29 which in turn actuates the solenoid 21 via a line 30.

It will be understood that some form of hysteresis must be provided in the valve control circuitry 29 to ensure that it does not rapidly open and close the feed valve. The valve control circuitry 29 as described in greater detail hereinafter includes a time delay so that, during a topping-up operation, filling continues through the feed valve for a predetermined interval after the water contacts the level sensing electrode 27. As the water boils away, its level has to drop a good way below the bottom of the sensing electrode 27 because of the bubbles at the surface before a topping-up signal is supplied by the level sensing device 29.

As water is continuously boiled away from the boiler, the amount of contamination in the water increases due to the continual supply of fresh town water. As the degree of contamination increases, the electrical resistance of the water falls and the electrode current rises. When the current has risen to the level required to give the desired water-vapour output, a current sensing device 32, positioned to sense or monitor the electrical current which flows through a sensed or monitored electrode 14*f*, actuates the solenoid 25 via the control circuitry 29 and a line 34 to open the drain valve 24, whereupon some of the water from the boiler is allowed to drain away. The valve remains open until the current sensing device 32 senses a desired reduction of electrode current. This draining maintains the electrical current to the electrode 14*f* within a predetermined range of value.

Figure 2:
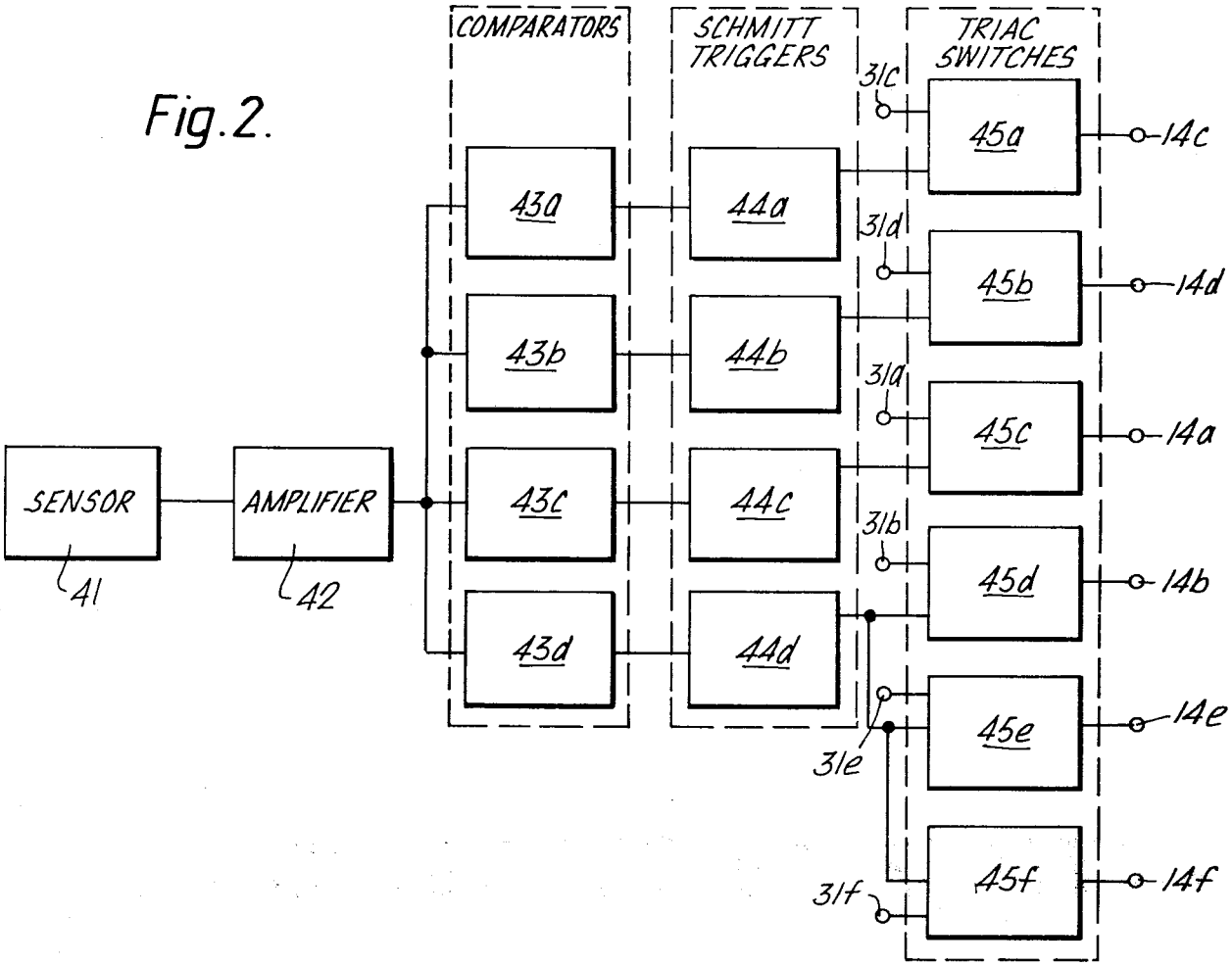
FIG. 2 is a block diagram of one possible circuitry for controlling operation of the electrodes.

One possible form for the electrode switching circuitry 33 in FIG. 1 is shown in block diagram form in FIG. 2. The humidity sensor 41 is constructed and arranged to provide an analogue electrical signal the magnitude of which is a function of the humidity of the room or other environment in which it has been placed. Its output is amplified by amplifier 42 and fed to respective inputs of four comparators 43*a* to *d*. These are previously set to give an output signal when fed with an input signal which falls to or drops below a predetermined voltage value. Each comparator has its own threshold level. Suppose, for example, that it is desired to maintain a relative humidity of 50% in an air-conditioned room. The comparator 43*a* may be set to give an output signal for a curent at or below a value which indicates a relative humidity of 44%. The comparator 43*b* may be set for 46%, 43*c* for 48%, and 43*d* for 50%. The comparators 43*a* to *d* are connected to switch triacs 45*a* to *f* via respective Schmitt triggers 44*a* to *d*. The last Schmitt trigger is connected to switch three triacs 45*d*, 45*e* and 45*f*. Triacs 45*a* to *f* switch electrodes 14*c*, 14*d*, 14*g*, 14*b*, 14*e* and 14*f* respectively. Thus, as the boiler feeds steam to the air-conditioned room and the humidity of the latter rises, on passing through 44% of the electrode 14*c* is switched off. With the humidity passing through 46%, the electrode 14*d* is switched off.

With the humidity passing through 48%, electrode 14*a* is switched off, so that only electrodes 14*b*, 14*e* and 14*f* remain switched on. In this minimum power position, a single phase connection results with the current in electrode 14*f* being contributed by one path from the adjacent electrode 14*e* and a second path from the electrode 14*b* which is spaced one position further away with the unconnected electrode 14*a* positioned between. These two currents are in phase and it is found that their arithmetic sum can readily be made equal to the vector sum of the two currents entering electrode 14*f* when electrodes 14*f*, 14*e* and 14*a* are connected to all three phases of a three phase supply.

Finally, on passing 50%, the last three electrodes 14*b*, 14*e* and 14*f* are switched off together so that no further steam is produced until the humidity falls below 50%, whereupon electrodes 14*b* 14*e* and 14*f* are switched in again. It may be preferable to shift all the threshold values up to 2%, in cases where three electrodes producing steam is usually just insufficient to maintain a level of humidity at 50%. The boiler may be designed to ensure this so that switching out of all electrodes will rarely occur, and the water will rarely be allowed to cool down.

With reasonably stable external environmental conditions, the relative humidity of the air-conditioned room would therefore be maintained at 50% by switching in and out electrode 14*a*, with electrodes 14*b*, 14*e* and 14*f* on continuously, so that the water is kept boiling all the time, only the rate of boiling being varied. Should the external conditions become drier, further electrodes would be switched in as necessary.

Typical currents in each electrode with the foregoing switching order would be as follows.

| Stage of | Current in Electrodes (Amps) | | | | | | Approx % max. |
|---|---|---|---|---|---|---|---|
| Connection | 14a | 14b | 14c | 14d | 14e | 14f | output |
| 1 | | 6 | | | 14 | 20 | 28 |
| 2 | 20 | 14½ | | | 14½ | 20 | 50 |
| 3 | 20 | 17 | | 17 | 20 | 20 | 75 |
| 4 | 20 | 20 | 20 | 20 | 20 | 20 | 100 |

From this table it can be seen that the current through the sensing or monitored electrode, electrode 14*f* is the same for all power levels, although the boiler will work sufficiently well provided the current in the monitored electrode remains within a predetermined range of values, in this case around 20 amps.

In the above description, the electrode 14*b* has been used as a balancing electrode in the lowest power single phase connection to make the electrode current in electrode 14*f* equal to that which it would carry in the three phase connection. The balancing electrode in this case is one of the other power electrodes which is a convenient arrangement. For effective balancing, there is at least one electrode, electrode 14*a* for example, which is closer to the sensed or monitored electrode 14*f* than is the balancing electrode 14*b*. It may however be a totally separate additional electrode provided only to give a balancing current in electrode 14*f* and so shaped and positioned that the additional current which it provides in electrode 14*f* is of just the correct magnitude.

One possible form for the valve control circuitry 29 is shown in FIGS. 3*a* and 3*b*. Inputs 46 and 48, being live A.C. and neutral inputs respectively, are shown in the top right hand corner of FIG. 3*b*. Most parts of the circuitry are well-known constructions, and will not therefore be described in detail. Thus that part of the circuitry boxed in and labelled 47 in FIG. 3*b* is input circuitry for building up a store charge, rectifying and smoothing the input current, and preventing triggering of triacs before the circuitry has stabilized directly after switch-on.

A time delay circuit 49 (see FIG. 3*a*) with a time constant of about 2 seconds is connected through a potential divider and rectifying diode to receive an output from the water level sensing electrode 27. The output from the time delay circuit 49 is fed to a comparator 50 with built-in hysteresis. The output 52 of the comparator 50 controls a triac switch 54 to activate the solenoid 21 and thus open the feed valve 20 shown in FIG. 1. The arrangement is such as to cause the valve 20 to open approximately 2 seconds after the water level in the boiler has dropped sufficiently for the bubbles not to reach the level sensing electrode 27, and to close approximately 2 seconds after the water level has risen, through opening of the valve, to re-establish contact between the water and the electrode 27. The two second delay results in a slight overfill, so that the feed valve is not opened and closed too frequently, as already explained.

A potential divider 56 shown in FIG. 3*a* is connected to receive an output from the current sensor 32. The values of the resistances in the potential divider 56 can be adjusted to determine the threshold current which, when reached or exceeded, will open the drain valve 24 shown in FIG. 1. The current sensor 32 is a toroid looping the electrical supply line to the electrode 14*f* of FIGS. 1 and 2. The output from it is therefore an alternating current or voltage, and this is accounted for by a precision rectifier 58 with gain connected to the divider 56. The output from the rectifier 58 is connected to a time delay circuit 60 which in turn is connected to a comparator 62 with built in hysteresis. The output 64 of the comparator 62 is connected to control a further triac switch 66 for activating the solenoid 25 of the drain valve 24 shown in FIG. 1. When the current or voltage in the current sensor 32 reaches or exceeds the threshold current, the series-connected parts 56, 58, 60, and 62 trigger the triac switch 66 to actuate the solenoid 25 and open the drain valve 24. The time delay circuit 60 ensures a slight overdrain 80 so that the drain valve 24 is not opened and closed too frequently.

In the event that the drain valve 24 becomes blocked by a flake of deposit from the boiler so that it cannot close properly, the continual leakage of water from the boiler will reduce the concentration of minerals and other impurities built up in the boiler, and hence the conductivity of the water. As a result, the correct current through the electrodes will never be reached, the boiler will cease to function correctly, and the drain valve 24 will not thereafter be opened to release the blockage. To prevent this happening, a monostable multivibrator 68 is connected between outputs 52 and 64. As a result, every time the feed valve is opened by an output signal from the comparator 50, the multivibrator 68 causes an electrical pulse to appear at the input to the triac switch 66, which thereby momentarily opens the drain valve 24 to clear any flaked deposit that is trapped in it.

If the threshold electrode current is not reached after an extended period of time, a comparator 70 connected to the time delay circuit 60 will trigger a triac switch 74 to turn on a neon warning light 76 indicating that the boiler is caked up too much with deposit and needs replacing.

The triac switches 55, 66 and 74 are all precisely the same.

One particular form of boiler is shown in FIGS. 4 and 5. It comprises a container made of upper and lower substantially cylindrical moulded parts 77 and 78 which are open at one end and made of a synthetic plastics material such as polypropylene. They are of substantially the same shape as one another and can therefore be made from the same mould. They are joined together and sealed at their open ends by a resilient rubber seal 79. The bottom part 83 of the lower part 78 is covered by a strainer 81 to prevent large flakes of deposit falling through and blocking the port. The upper part 77 is formed with the bushes 13 which support upper ends of the six electrodes 14*a* to *f*. Each electrode comprises a rod 80 extending vertically from the bushes 13 practically to the bottom of the container's interior. Each rod 80 is surrouned by a cylindrical metal wire mesh or expanded metal mesh 82 fixed to the rod by a straight portion of mesh 84 extending between the rod and the cylinder of mesh.

The electrodes are separated from one another by polypropylene or other synthetic plastics baffles or partitions 86 in star-shaped arrangement to reduce the conductivity of the ion flow path between the various electrodes to a desired level, and to decrease the effect in switching off electrodes on the sensed current. Extensions 88 from the base of partition 86 provide spigots 90 for receiving and supporting the lower ends of the electrode rods 80.

The level-sensing electrode 27 may be protected to some extent from spurious level detection owing to bubbles at the water surface by means of a shield 92 extending from the container interior side wall just below the bottom of the electrode 27.

A twelve-electrode cylinder may be constructed having electrode a to l inclusive connected sequentially to phases 1, 2 and 3, such that electrodes a, d,g and j are connectable to phase no.1, electrodes b, e, h and k are connectable to phase no. 2, and electrodes c, f, i and l are connectable to phase no. 3. The electrodes may be arranged around the circumference of a pitch circle at 30° intervals or alternatively may be grouped in four separate 3 phase groups of a b c, d e f, g h i and j k l.

A method of providing four roughly equal stages of vapour output with this cylinder is to switch the four three phase electrode groups a b c, d e f, g h i and j k l in sequence. If the electrodes are arranged on a pitch circle, the centre electrode of the first group, electrode b, must be used as the current sensing electrode, in order that the switching of the other electrode groups will have negligible effect on the current in the current sensing electrode.

Alternatively, with such a 12-electrode cylinder, a very fine control providing 10 steps of output from about 14% to 100% may be achieved in the following way. On step 1, electrodes a, b, and d should be connected, with electrode b used as the current-sensing electrode and electrode d as the current-balancing electrode. The remaining 9 electrodes may then be connected one at a time without significantly affecting the current in the sensing electrode. If fewer steps are needed, some or all of the remaining 9 electrodes may be connected to groups of 2 or more to achieve the desired number of steps and output intervals.

In comparison with earlier forms of electrode boiler, one of the major advantages of the boilers described above is that they will operate equally well whether the water supplied to them is rich or sparse in mineral content. This fact will be seen more clearly from the following theoretical considerations surrounding the operation of electrode boilers generally.

It is a desirable feature of an electrode boiler to be able to vary the vapour output in resonse to a control signal. Prior methods of control for such boilers are described, for example, in U.S. Pat. No. 3,780,261 wherein feed and drain valves are controlled in response to sensing the current in one electrode with the objective of maintaining a substantially constant current/time repetitive cycle and providing the functions of replenishing water to the boiler as necessary and draining a constant proportion of that fed from the boiler.

As the life of such a boiler progresses, the electrodes scale up and so their conductivity progressively decreases. The result of this is that, if all other factors, namely the electrode current, the voltage between the electrodes and the conductivity of the water in the boiler, remain constant, the operating water height progressively rises.

A method of varying the output of such a boiler has been described by varying the electrode current thresholds at which the feed and drain valves operate. A reduced vapour output therefore requires a reduced electrode current and, as all other factors remain the same, the immersed height must be very much reduced.

If the control response is to be achieved quickly, this means draining hot water from the boiler to reach the lower operating water level and this is wasteful of energy. An alternative method has been used of allowing the water to boil away without replenishment until the lower water level is reached, but in this case the time taken to change to the lower vapour output is usually much too long in relation to a demand control response time. Similarly, on control demand for a greater output, the water level must be made to rise by adding a considerable quantity of cold water and there is some delay before the greater output is achieved whilst this water is heated up.

The present invention avoids these drawbacks of earlier electrode boilers and earlier methods of controlling them, its great advantage being that, with the use of comparatively easily-produced means, energy losses are substantially reduced without placing any undesirable restriction on the way in which the boiler is used in practice.

One particular electrode boiler to which the invention is especially applicable is that described and claimed in U.S. Pat. No. 3,944,785. Accordingly, the operation of an electrode boiler constructed in accordance with the invention of that Patent and also in accordance with the present invention will now be described in detail as follows.

On initially switching the unit on, with an empty steam cylinder, the feed valve will open and the drain valve will remain closed. The cylinder will then fill with water until the water level reaches the level sensing electrode following which the feed valve will close. At this time, the electrode current will be very low and certainly well below the normal operating current. However, as some current is flowing the water will gradually heat up and will eventually boil. As the water boils away, the water level will fall and, after a short period, will drop below the level of the level sensing electrode. This will cause the feed valve to open again, topping up the cylinder with fresh water until the level sense electrode is again immersed whereupon the feed valve will close again. This process of boiling water away and topping up with feed water will continue repeatedly throughout the operation of the unit. At the end of each successive feed, the electrode current will be slightly higher than that reached at the end of the previous feed. This is because the fresh water entering the cylinder has a small content of dissolved minerals, whereas the water leaving the cylinder as steam is mineral-free and carries no minerals away with it. The quantity of minerals dissolved in the water in the cylinder therefore steadily increases during this process. As the electrical conductivity of the water depends on the concentration of dissolved minerals in the water, this will also steadily rise and therefore so will the electrode current. Eventually this current will reach the required operating value to give the required steam output. This process is entirely automatic and may take between a few minutes and several hours according to the mineral content of the feed water. If this is low (very pure water) start-up will be slow, whereas if it is high (less pure or hard water) start-up will take less time. However, even if the start-up is slow, it occurs only once when a new steam cylinder is fitted. On all subsequent starts full output will be generated within a short period of switching on, provided of course that water has not been manually drained from the cylinder.

After the start-up period is completed, the unit will operate automatically throughout the steam cylinder life at substantially constant output, regardless of any likely changes in the mineral content of the feed water. This is achieved in the following way. When the electrode current as measured at the end of a feed period has reached a preset value, equivalent to a value just above that required to give the set steam output, a drain cycle is initiated by opening the drain valve. Water which is enriched in minerals then drains from the cylinder. When a controlled quantity of water has left the cylinder, the drain valve closes and the feed valve opens, filling the cylinder again up to the level-sensing electrode. The mineral-enriched water has therefore been replaced by an equal quantity of feed water with a lower mineral content so reducing the average mineral content of the water in the cylinder and hence its electrical conductivity. As a result, the electrode current is also reduced to a level slightly below the preset threshold value. The system then continues to operate with sequential boil and feed periods and the electrode current gradually rises again due to the rise in conductivity of the water in the cylinder.

When the electrode current reaches the preset threshold value again, another drain period is initiated. This process is then continuously repeated automatically. It will be found that if the system is fed with water having a high mineral content the drain periods will occur frequently, whilst if the feed water has a low mineral content, there will be long intervals between drain periods. During the life of the steam cylinder, the electrodes will gradually become coated with scale and as a result their conductivity to the water will reduce. The electrode boiler shown in U.S. Pat. No. 3,944,785 compensates for this effect exactly equally and oppositely by allowing the conductivity of the water in the cylinder to rise gradually so that the electrode current always stays at the desired value. As this process progresses the drain periods (of constant water volume) each carry away more minerals and so fewer are needed. The system therefore becomes more efficient as the cylinder life progresses. Eventually, as the electrodes become excessively scaled, the rate of increase of the water conductivity can no longer compensate for the rate of decrease of the electrode conductivity. When this occurs the drain periods cease altogether with the electrode current falls off quite rapidly.

The delay on start-up can be eliminated by introducing a 'start-up tablet' of say, sodium chloride, into a new, or refilled, cylinder. When the cylinder is initially filled with water, this tablet quickly dissolves and provides sufficient conductivity to give the required electrode current even when the feed water has a very low mineral content. If the feed water already has a significant mineral content and hence conductivity, the total conductivity of the water in the cylinder, after the 'start-up tablet' has dissolved may be higher than required. This however presents no problem to the system. The result will be either that the required electrode current is reached on filling before the cylinder is full of water, or, alternatively, that with the cylinder full of water, the electrode current rises above the required value as the water heats up.

In either case, as soon as the electrode current reaches or begins to exceed the required value, the drain valve opens, and water having a high mineral content is drained from the cylinder and is replaced by feed water having a lower mineral content, so reducing the conductivity of the water in the cylinder. This drain and refill sequence may be repeated several times in succession, the excess minerals being removed from the cylinder until the correct mineral content is established which will give the conductivity needed to provide the required electrode current when the water level is at the level sense electrode. The system will then continue to operate as described above.

The circuitry shown in FIGS. 3*a* and 3*b* may be adapted so that, instead of opening the drain valve immediately when the threshold current in the sensing electrode 14*f* is reached, a latch is operated which enables the drain valve to operate but inhibits the feed valve from operating. The drain valve is not then actually opened until the current in the sensing electrode 14*f* has fallen to about 90% of the threshold value. This ensures that the system does not revert to operation as set out in the foregoing description with reference to U.S. Pat. No. 3,780,261 with frequent draining, in the event that the feed water is of very high conductivity. Such reversion might otherwise occur, since the threshold current in the sensing electrode may be reached before the water level in the boiler reaches the level sensor.

To avoid controlling excessive electrode current a further current sensing comparator may be incorporated into the circuitry shown in FIGS. 3*a* and 3*b* to open the drain valve, over a monitoring hysteresis cycle, at about 110% of the threshold value.

Where the water supplied to the boiler is of very low conductivity, a further comparator may be provided in the switching circuitry to given an output signal for as long as the sensed electrode current remains below 90% the threshold value. A further solenoid valve is arranged as a by-pass valve, to direct the feed water into a small cylinder containing conductivity increasing material, for as long as it receives the output signal from the further comparator. Once this output signal ceases, when the electrode current reaches 90% of the threshold value, the by-pass valve is closed and the system thereafter passes the feed water directly to the boiler. As a result of this modification, the start-up period of the system is considerably reduced.

I claim:

1. A multi-electrode boiler, especially for use as a humidifier, comprising water-changing means arranged to allow at least some of the water in the boiler to be changed, monitoring means arranged to monitor the electrical-current which flows through at least one of the electrodes of the boiler, control means responsive to the monitoring means to control the change of at least some of the water in the boiler to maintain the electrical-current in said at least one monitored electrode within a predetermined range of values, in which switching circuitry is provided to switch in and out electrodes of the boiler to vary the boiling rate, wherein the monitoring means are arranged to monitor the electrical current which flows through at least one but less than all of the electrodes in the boiler, and wherein the switching circuitry ensures that the electrodes of the boiler which are not monitored are switched in successively in such an order, for successively increasing boiling rate, that the value of the electrical-current passing through said at least one monitored electrode remains within a predetermined range of values.

2. A boiler according to claim 1, in which the switching circuitry is so connected that, for a low boiling rate, at least one electrode which is not monitored is switched in as a balancing electrode to ensure that the electrical current passing through said at least one monitored electrode remains within a predetermined range of valves when further electrodes are switched in, there being at least one electrode which is nearer to said at least one monitored electrode than is the balancing electrode.

3. A boiler according to claim 1, in which the electrodes of the boiler which are not monitored are so constructed and arranged that, for successively increasing boiling rates, the value of the electrical-current passing through said at least one monitored electrode remains within a predetermined range of values.

4. A boiler according to claim 1, in which change of at least some of the water in the boiler is controlled when the monitored electrical current reaches at least one predetermined threshold value.

5. A boiler according to claim 4, in which said at least one predetermined threshold value is altered according to the number of electrodes which are switched in at any given instant.

6. A boiler according to claim 1, further comprising a water-level sensor positioned to sense when a given level of water in the boiler is reached, the control means also being connected to the water level sensor to maintain the level of water in the boiler within a predetermined range of levels.

7. A boiler according to claim 1, in which the switching circuitry includes a humidity sensor connected to increase the number of electrodes which are switched in as the sensed humidity decreases.

8. A boiler according to claim 1, in which the electrodes are elongate and are substantially parallel with one another, and are upright when the boiler is in use.

9. A boiler according to claim 1, in which the water-changing means includes a drain valve for draining water from the boiler, and the control means include pulse means to open the drain valve momentarily at a time when draining of water from the boiler is not required, to allow any solid material which may be trapped in the drain valve, thereby preventing complete closure thereof, to be released.

10. A method of generating steam, using a multi-electrode boiler comprising water-changing means arranged to allow at least some of the water in the boiler to be changed, monitoring means arranged to monitor the electrical-current which flows through at least one of the electrodes of the boiler, control means responsive to the monitoring means to control the change of at least some of the water in the boiler to maintain the electrical-current in said at least one monitored electrode within a predetermined range of values, in which switching circuitry is provided to switch in and out electrodes of the boiler to vary the boiling rate, wherein the monitoring means are arranged to monitor the electrical current which flows through at least one but less than all of the electrodes in the boiler, and wherein the switching circuitry ensures that the electrodes of the boiler which are not monitored are switched in successively in such an order, for successively increasing boiling rates, that the value of the electrical-current passing through said at least one monitored electrode remains within a predetermined range of values.

* * * * *